United States Patent [19]

Dudley

[11] 4,344,618

[45] Aug. 17, 1982

[54] EXERCISE APPARATUS

[76] Inventor: William H. Dudley, 1531 Sheridan Ave. North, Minneapolis, Minn. 55411

[21] Appl. No.: 114,100

[22] Filed: Jan. 21, 1980

[51] Int. Cl.[3] ..... A63B 21/06

[52] U.S. Cl. ..... 272/117; 272/134; 272/900; 272/93

[58] Field of Search ..... 272/117, 119, 143, DIG. 4, 272/62, 93, 900, 134

[56] References Cited

U.S. PATENT DOCUMENTS

| | | | |
|---|---|---|---|
| 232,022 | 9/1880 | Gifford et al. | 272/117 |
| 3,558,130 | 1/1971 | Anderson | 272/117 X |
| 4,050,693 | 9/1977 | Lichterman | 272/62 X |
| 4,185,816 | 1/1980 | Bernstein | 272/93 |

*Primary Examiner*—Richard C. Pinkham
*Assistant Examiner*—William R. Browne
*Attorney, Agent, or Firm*—Clayton R. Johnson

[57] ABSTRACT

Exercise apparatus that includes a main support having an upper end portion, a vertically elongated intermediate portion and a lower end portion, a cross support member of an adjustable horizontal width secured to the main support upper end portion and being mountable to and between the sides of a door frame, hand grip members pivotally mounted to extend horizontally outwardly of opposite sides of the intermediate portion, and foot supports pivotally mounted to extend horizontally outwardly of opposite sides of the lower end portion. Pulleys may be mounted on the cross support member and the hand grip mounting member to have ropes extended thereover for pulling weights. Further, a bar and strap may be used to aid in retaining the main support in its mounted position in the doorway when the user has his feet in the foot supports while doing sit-ups.

16 Claims, 5 Drawing Figures

EXERCISE APPARATUS

BACKGROUND OF THE INVENTION

Exercise apparatus that is at least in part supported by a door frame.

In U.S. Pat. No. 250,738 there is disclosed portable gymnastic apparatus that includes a horizontal bar mounted by two sockets secured to a doorway casing, vertical bars having upper ends connected to the cross bar, a horizontal bar mounted by the vertical members and a seesaw board mounted by the vertical members. U.S. Pat. No. 3,593,708 discloses a trapeze bar mounted on a cross bar secured to sides of a door frame while each of U.S. Pat. Nos. 1,401,476 and 3,525,521 disclose horizontal bars having resilient pads mounted on opposite sides thereof to frictionally engaged opposite sides of a door frame. U.S. Pat. No. 3,713,653 discloses an exercise device that has vertical member mounted on a base, a handbar rotatably mounted on the upper end portion of the vertical member and a turntable pivotally mounted on the base for a user to stand on while gripping the handbar.

Various exercises can be performed on prior art devices such as the above, however none of such prior art devices are suitable for use to perform many of the exercises that can be performed with the apparatus of this invention.

SUMMARY OF THE INVENTION

Exercise apparatus that includes a main support having an upper end portion, a vertically elongated intermediate portion and a lower end portion, a cross support member mounted by and between the opposite sides of a door frame and secured to the upper end portion to extend horizontally outwardly on opposite sides thereof, hand grip members pivotally mounted on the intermediate portion to extend outwardly on opposite sides thereof, and foot supports located on opposite sides of the lower end portion and pivotally connected thereto.

One of the objects of this invention is to provide new and novel means for carrying out a different variety of exercise routines than can be done on conventional apparatus. Another object of this invention is to provide new and novel exercising means that at least in part is supportingly mountable by a door frame and has foot supports for supporting at least part of the body weight and hand grips for supporting at least part of the body weight during use. An additional object of this invention is to provide new and novel means for exercising many different parts of the body during use.

BRIEF DESCRIPTION OF THE DRAWINGS

FIG. 1 is a front view of the apparatus of this invention with a vertically intermediate part broken away and a part shown in cross section, and additionally showing pulleys that may be used therewith for pulling weights;

Figures 2, 3, 4, 5, 7:
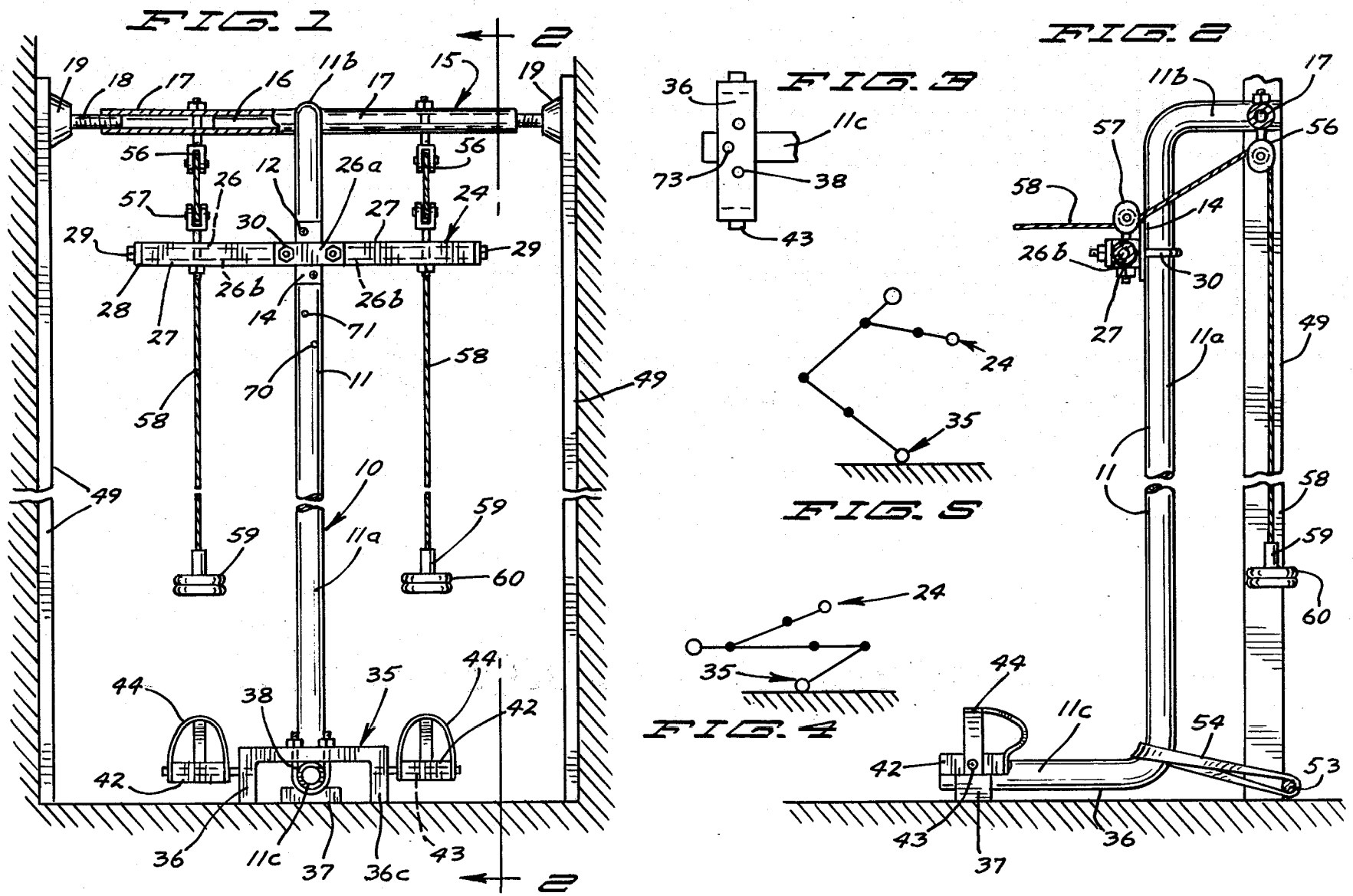
FIG. 2 is a side view, part in cross section, that is generally taken along the line and in the direction of the arrows 2—2 of FIG. 1, said view showing weights in an elevated position and a strap and bar that may be optionally used.
FIG. 3 is a fragmentary plan view showing the member for mounting the supports on the main support lower end portion.
FIG. 4 is a stick figure representation of a user in a bent position on the apparatus of this invention.
FIG. 5 is a stick figure representation of a user in one position while performing an exercise different from that represented in FIG. 4.

Referring now to the drawings, the apparatus of this invention, generally designated 10, includes a main support 11 that has an upper end portion **11*b*, a vertically elongated intermediate portion 11*a*, and a lower end portion 11*c*. The upper end portion (leg) has one end integrally joined to the upper end of the intermediate portion to extend horizontally away therefrom while the lower end portion (leg) has one end integrally joined to the lower end of the intermediate portion to extend horizontally away therefrom in a direction opposite the extension of leg 11*b*** away from the intermediate portion.

In order to supportingly retain the main support in a position for use there is provided a cross bar assembly generally designated 15 that includes a horizontal bar 16 which may be hexagonal in cross section, has its midportion extended through leg **11*b* and suitably secured in a fixed position on the leg 11*b* to be substantially horizontally offset from leg 11*a*. Each end portion of bar 16 has one end portion of a horizontally elongated tube 17 extended thereover to be in abutting relationship to the adjacent side of the main support. The opposite end portion of each tube threadingly mounts a bolt 18 that has its head end embedded in a resilient pad 19**.

Mounted on leg **11*a* is a hand grip assembly, generally designated 24. Assembly 24 includes a straight cross bar 26 which may have an intermediate portion 26*a* of rectangular cross section and opposite cylindrical end portions 26*b*. On each end portion 26*b* there is rotatably mounted an axially elongated tubular hand grip 27, bolts 29 being threaded into terminal end portions of bar 26 to have the head ends thereof abut against annular retainers 28 which in turn abuts against the adjacent end of the respective hand grip for retaining the hand grips adjacent portion 26*a*** to prevent any substantial axial movement of the hand grips on the bar. Thus, the hand grips are mounted for independent pivot movement about a common pivot axis.

Located between intermediate portions **26*a* and 11*a* is a cross plate 14 (shape of a cross having vertical legs secured to the main support intermediate portion by nuts and bolts 12 and horizontal legs. Nuts and U-bolt 30 are provided for retaining the cross bar 26 at selected vertically adjusted positions on leg 11*a* with the hand grips extending horizontally outwardly thereof on opposite sides of leg 11*a*. The U-bolt is also extended through apertures in the horizontal legs of the cross plate. Advantageously, a plurality of vertically spaced apertures 70, 71 are provided in the main support intermediate portion to have bolts 12 extended therethrough to facilitate vertical adjustment of the cross bar 26**.

A foothold assembly, generally designated 36, includes a generally U shaped cross member 36 that may have a screw 73 extended through the horizontally elongated web portion thereof and threaded into leg **11*c* (or a nut and bolt in place of the screw). Nuts and U-bolt 38 clamp the cross member to leg 11*c* to extend outwardly on opposite sides thereof. By providing horizontally spaced apertures (not shown) on leg 11*c*, the cross member can be retained in adjusted horizontal spaced relationship to support intermediate portion 11*a***.

The cross member includes vertical legs **36*c*** depending from its web for supporting the adjacent port of leg 11*c* is vertical spaced relationship to the floor. The legs 36*c* are horizontally spaced from leg 11*c* and on opposite sides thereof to prevent leg 11*c* pivoting about its central axis during use. A foot support is mounted on each end portion of the cross member, each foot support including a foot pedal 42 mounted on a pedal shaft 43 to pivot about a pivot axis that is coextensive with the pivot axis for the other foot pedal and parallel to the hand grip pivot axis. Each pedal shaft is mounted by one of the legs 36*c*, the shafts extending outwardly from the legs in opposite directions. Foot straps or web 44 are secured to each foot pedal to extend over the top of the user's foot to aid in retaining the foot on the foot pedal. As may be noted from FIG. 1, the horizontal spacing of the foot supports is less than the horizontal spacing of the remote ends of the hand grips. Additionally, the foot supports are located at a substantially lower elevation than the hand grips and horizontally offset therefrom.

A pad 37 is bolted or otherwise appropriately secured to the underside of leg 11*c* adjacent the juncture thereof to intermediate portion 11*a* to aid in supporting the main support on a floor during use. As may be noted from FIG. 2 cross member 36 is located substantially more horizontally remote from intermediate portion 11*a* than pad 37.

For use of the invention the main support is moved to a position to have the cross bar assembly located between opposite sides of a door frame 49. Now bolts 18 are threaded in the appropriate directions relative tubes 17 so that the pads 19 abut against the door frame sides under sufficient pressure to mountingly retain the main support in an upright mounted condition during use. If necessary, the hand grip assembly may be vertically adjusted on the main support by unthreading the nuts on U-bolt 30, removing bolts 12 thence vertically repositioning the assembly on the intermediate portion and then fastening bolts 12 to hold the assembly in an adjusted position. Thereafter the nuts on U-bolt 30 are tightened, the U-bolt providing additional strength to prevent the hand grip assembly being broken away from intermediate position 11*a*.

The user, while gripping the hand grips and facing the intermediate portion, inserts his feet into the foot supports, and then stands in an upright position. Now a variety of exercise routines may be performed. For example, the user while retaining his legs straight may arch his back to bow outwardly of the main support intermediate portion such as generally indicated in FIG. 5. While arching his back the hand grips pivot on cross bar 26 and the foot pedals pivot about the pedal shafts. During this routine the bending is primarily at the hips and acts to stretch the back along the spinal column. Another possibility such as is partially indicated in FIG. 4, the user may arch his back and bend his knees such that his knees extend forwardly of main support intermediate portion, his head extends lower than his shoulders and knees and is located on opposite sides of the support member intermediate portion from his knees, the support member intermediate portion extends upwardly between his thighs, and his abdomen faces upwardly. The above are set forth as examples of exercises that may be performed and not as a limitation, as others can be performed on the apparatus. By using the apparatus of this invention, many body muscles, including those of the legs, arms, back and abdomen, can be exercised.

Additionally, a user may do sit-ups by placing his feet in the foot supports and sitting on the floor. Preferably before doing sit-ups, a bar 53 is extended across the lower part of the doorway to abut against opposite sides of the door frame on the side opposite the main support intermediate portion and a strap 54 connects the bar 53 to the intermediate portion of the support adjacent legs 12*a*, 12*b* to prevent the lower portion of the main support accidentally pulling away from the door frame (bar 53 and strap 54 shown only in FIG. 2).

For pulling weights, a combination of a pulley and an eyebolt or hook 56 is secured to each tube 17, a combination of a pulley and an eyebolt or hook 57 is secured to each hand grip and cross bar 26, and a rope 58 is extended partially around the pulleys on each side of the main support such as partially indicated in FIGS. 1 and 2. One end of the rope is connected to a weight holder 59 for holding weights 60. By pulling on the ropes, the weights will be elevated above floor level.

The apparatus of this invention can be used by some people that are at least temporarily confined to wheelchairs. Such wheelchair parties can move the wheelchair to a position to place their feet in the foot supports and grasp the hand grips to pull themselves out of the wheelchair, and after exercising, sit back down in the wheelchair without aid by others.

If desired, sockets such as disclosed in U.S. Pat. No. 250,738 may be used for supportingly mounting tubes 17 on the door frame side members. However, by using the resilient pads 19 no holes have to be made in the door frame and the exercise apparatus can be readily removed from the doorway after use.

If the main support is made of tubular material such as lightweight aluminum, advantageously an aluminum reinforcing sleeve (not shown) is provided on leg 11*b* and has bar 16 extended through apertures therein. Further, an aluminum reinforcing sleeve (not shown) is provided on leg 11*a* to form a close sliding fit therewith and have U-bolt 30 abut thereagainst. Bolts 12 may optionally extend through the last mentioned sleeve or the sleeve may terminate between the bolts, depending upon the strength of materials used and the spacing of the bolts 12.

In the event the apparatus of this invention is to be used by a party who has only one hand (or sufficient strength in only one hand), in place of hand grip assembly 24 there may be provided a hand grip assembly (not shown) that is mounted on leg 11*c* by members 12, 14, 30; and has a bar portion about the size of bar portion 26*a* to which there is joined a generally U-shaped portion that pivotally mounts a horizontal tube to pivot about an axis parallel to the pivot axis of the foot supports and located a short distance horizontally away from leg 11*a* in the direction leg 11*c* extends away from leg 11*a*.

What is claimed is:

1. Exercise apparatus comprising a main support member having an upper end portion, a vertically elongated intermediate portion having an upper end joined to the upper end portion and a lower end, and a lower end portion joined to the intermediate portion lower end to extend horizontally away therefrom in a given direction, a first and a second foot support, means for mounting the foot supports to and on opposite sides of the lower end portion in relation to said given direction, a first and a second hand grip, means for mounting the hand grips on the intermediate portion on opposite sides thereof in relation to said given direction, the last mentioned means being at a substantially higher elevation than the foot supports, and cross bar means adapted for mountingly engaging the opposite sides of a door frame, said cross bar means being connected to the upper end portion to extend outwardly thereof on opposite sides thereof in relation to said given direction.

2. The apparatus of claim 1 further characterized in that the means for mounting the hand grips includes means for mounting the hand grips for pivotal movement.

3. The apparatus of claim 1 further characterized in that each of the hand grips is tubular and that the means mounting the hand grips comprises means for mounting the hand grips for independent rotation about a common axis.

4. The apparatus of claim 1 further characterized in that the means for mounting the foot supports comprises means for mounting the foot supports for pivotal movement about a common horizontal axis.

5. The apparatus of claim 4 further characterized in that each foot support includes a foot pedal and means secured to the foot pedal for extension over the top of a foot to aid in retaining a foot on the foot pedal.

6. The apparatus of claim 4 further characterized in that the means for mounting the hand grips comprises means mounted on the intermediate portion for mounting the hand grips for pivotal movement about a horizontal axis that is parallel to said common axis, at a substantially higher elevation than said common axis and horizontally offset from said common axis.

7. The apparatus of claim 1 further characterized in that there is provided means adapted for abutting against a floor, the last mentioned means being connected to the lower end portion.

8. Exercise apparatus comprising a main support having an upper end portion, a vertically elongated intermediate portion and a lower end portion, means on the lower end portion adapted for engaging a floor, cross bar means adapted for mounting engagement with opposite sides of a door frame, said cross bar means being mounted on the upper end portion, a first and a second hand grip, means for mounting the hand grips on the intermediate portion for pivotal movement independent of each other, a first and a second foot support, and means for mounting the foot supports on the lower end portion for pivotal movement independent of each other to support a user's feet while the user grips the hand grips.

9. Exercise apparatus comprising a main support member having an upper end portion, a vertically elongated intermediate portion having an upper end joined to the upper end portion and a lower end, and a lower end portion joined to the intermediate portion lower end to extend horizontally away therefrom in a given direction, a first and a second foot support, means for mounting the foot supports to and on opposite sides of the lower end portion in relation to said given direction, a first and a second hand grip, means for mounting the hand grips on the intermediate portion on opposite sides thereof in relation to said given direction, the last mentioned means being at a substantially higher elevation than the foot supports, and cross bar means adapted for mountingly engaging the opposite sides of a door frame, said cross bar means being connected to the upper end portion to extend outwardly thereof on opposite sides thereof in relation to said given direction, the upper end portion being horizontally elongated and extending away from the intermediate portion in a direction opposite said given direction and the cross bar means being mounted by the upper end portion substantially horizontally offset from the intermediate portion.

10. Exercise apparatus comprising a main support member having an upper end portion, a vertically elongated intermediate portion having an upper end joined to the upper end portion and a lower end, and a lower end portion joined to the intermediate portion lower end to extend horizontally away therefrom in a given direction, a first and a second foot support, means for mounting the foot supports to and on opposite sides of the lower end portion in relation to said given direction, a first and a second tubular hand grip, means for mounting the hand grips on the intermediate portion on opposite sides thereof in relation to said given direction, the last mentioned means being of a subtantially higher elevation than the foot supports, and cross bar means adapted for mountingly engaging the opposite sides of a door frame, said cross bar means being connected to the upper end portion to extend outwardly thereof on opposite sides thereof in relation to said given direction, the means for mounting the hand grips comprising a straight bar having a first end portion, an intermediate portion and a second end portion and means for mounting the bar intermediate portion on the support member intermediate portion in various selected vertically adjusted positions, the first hand grip being pivotally mounted on the bar first end portion and the second hand grip being pivotally mounted on the bar second end portion.

11. Exercise apparatus comprising a vertically elongated support member having an upper end portion, a vertically elongated intermediate portion having an upper end joined to the upper end portion and a lower end, and a lower end portion having a first end joined to the intermediate portion lower end and extending horizontally away therefrom, a first foot support, a second foot support, means for mounting said foot supports in horizontal spaced relationship on the lower end portion for pivotal movement about a first common horizontal axis, a first hand grip, a second hand grip, and means for mounting the hand grips on the support member for pivotal movement about a second common axis that is parallel to the first common axis, the means for mounting the foot supports including a horizontally elongated mounting member extending transverse to the lower end portion and having an intermediate portion, and means for mounting the mounting member intermediate portion on the lower end portion in substantial horizontal spaced relationship to the support member vertical intermediate portion.

12. The apparatus of claim 11 further characterized in that the support member upper end portion is horizontally elongated and has one end joined to the intermediate portion upper end to extend away therefrom in a direction generally opposite that the lower end portion extends from the support member intermediate portion and that there is provided cross bar means mounted on the upper end portion in horizontal spaced relationship to the support member intermediate portion for supportingly retaining the upper end portion in spaced relationship to door frame side members.

13. The apparatus of claim 12 further characterized in that the mounting member has end portions on opposite sides of the lower end portion in depending relationship to the mounting member intermediate portion for supporting the lower end portion above a floor, and that the means for mounting the hand grips comprises means for mounting the hand grips in selected vertically adjusted positions on the support member intermediate portion.

14. Exercise apparatus comprising a vertically elongated support member having an upper end portion and a lower end portion, a first foot support, a second foot support, means for mounting said foot supports in horizontal spaced relationship on the lower end portion for pivotal movement about a first common horizontal axis, a first hand grip, a second hand grip, and means for mounting the hand grips on the support member for pivotal movement about a second common axis that is parallel to and above the first common axis, the means for mounting the hand grips comprising a generally straight horizontally elongated member having an intermediate portion mounted by the support member, a first end portion and a second end portion, the first hand grip being pivotally mounted on the last mentioned member first end portion and the second hand grip being pivotally mounted on the last mentioned member second end portion.

15. Exercise apparatus comprising a vertically elongated support member having an upper end portion and a lower end portion, a first foot support, a second foot support, means for mounting said foot supports in horizontal spaced relationship on the lower end portion for pivotal movement about a first common horizontal axis, the means for mounting the foot supports comprising a generally straight horizontally elongated member having an intermediate portion mounted by the support member, a first end portion, and a second end portion, the first foot support being pivotally mounted on the last mentioned member first end portion and the second foot support being pivotally mounted on the last mentioned member second end portion, a first hand grip, a second hand grip, and means for mounting the hand grips on the support member for pivotal movement about a second common axis that is parallel to and above the first common axis.

16. Exercise apparatus comprising a vertically elongated support member having an upper end portion and a lower end portion, a first foot support, a second foot support, means for mounting said foot supports in horizontal spaced relationship on the lower end portion for pivotal movement about a first common horizontal axis, a first hand grip, a second hand grip, means for mounting the hand grips on the support member for pivotal movement about a second common axis that is parallel to and above the first common axis, and horizontally elongated cross bar means for mountingly engaging a door frame, the cross bar means having an intermediate portion mounted on the support member upper end portion.

* * * * *